US006234274B1

(12) United States Patent
van der Griendt

(10) Patent No.: US 6,234,274 B1
(45) Date of Patent: May 22, 2001

(54) LOW PROFILE NIPPLE

(75) Inventor: A. John van der Griendt, Bloomfield Hills, MI (US)

(73) Assignee: K. J. Manufacturing, Inc., Wixom, MI (US)

( * ) Notice: Subject to any disclaimer, the term of this patent is extended or adjusted under 35 U.S.C. 154(b) by 0 days.

(21) Appl. No.: 09/298,781

(22) Filed: Apr. 23, 1999

(51) Int. Cl.[7] ..... F01M 11/04

(52) U.S. Cl. ..... 184/105.3; 184/1.5; 184/106; 123/196 R; 285/94

(58) Field of Search ..... 184/1.5, 105.3, 184/106; 123/196 R; 285/94, 95

(56) References Cited

U.S. PATENT DOCUMENTS

| | | | | |
|---|---|---|---|---|
| 4,745,894 | * | 5/1988 | Laipply et al. | 123/196 R |
| 4,951,723 | * | 8/1990 | Hoeptner, III | 141/351 |
| 5,411,114 | | 5/1995 | Bedi et al. | 184/1.5 |
| 5,568,946 | | 10/1996 | Jackowski | 285/38 |
| 5,588,502 | | 12/1996 | Bedi et al. | 184/1.5 |
| 5,711,549 | | 1/1998 | Beans | 285/93 |

* cited by examiner

*Primary Examiner*—David Fenstermacher
(74) *Attorney, Agent, or Firm*—Young & Basile, P.C.

(57) ABSTRACT

An apparatus for retrofitting a vehicle for removing spent oil from an oil pan reservoir installed in an access aperture located in a floor bottom of the oil pan reservoir. The device includes a low profile quick connect nipple having a first end threadably sealing into the access aperture and a second end releasably engagable with a mating fitting positioned on an externally located fluid delivery device and further having a fluid tight closure when the second end is disengaged from the fluid delivery device. The apparatus has a center throughbore having a movable member therein. The movable member includes a stem and a circular flared portion. A retainer clip is securely attached to an upper end of the stem. A ring configuration has a center through aperture for receiving the stem and radial connections extending to the periphery of the throughbore. The ring configuration centers the stem and defines a stop for the movable member when the retainer clip contacts the ring configuration.

23 Claims, 2 Drawing Sheets

LOW PROFILE NIPPLE

FIELD OF THE INVENTION

This invention relates to a nipple for a fluid access port for connection to a coupler.

BACKGROUND OF THE INVENTION

There is a need to provide a low profile quick connect nipple to a fluid access port for a fluid reservoir when the surrounding area of the reservoir is space limited. This is particularly true for the oil pan of a vehicle and its associated drain plug. To remove the contaminated oil from a vehicle, the drain plug generally located in the lowermost region of the oil pan is removed. Spent oil containing suspended particles is permitted to flow under gravity out of the pan into a suitable receptacle. After the spent oil is removed, the plug is replaced and fresh oil is added to the engine usually through a separate opening in the engine valve cover. The oil change process is essentially the same whether performed at home, at service stations or at one of the various oil change centers which have opened in recent years. It is therefore desirable to provide an oil pan adapter device which would eliminate the need for repeated removal and insertion of the drain plug with each oil change operation and that is suitably configured to permit automatic sealing between oil change operations.

The current style of quick connect nipples usable for oil pans has a projection of several inches below the oil pan. The exposure makes the nipple vulnerable to damage as a result of being hit by road debris and/or low clearance between the oil pan and the road surface. The projection provides for significant leverage, which could aggravate the amount of damage to the nipple, including tearing the nipple from the oil pan.

In cases where the oil pan thread is small, a special adapter is used in conjunction with the quick connect nipple, which increases the projection of the nipple by as much as one-quarter inch. The adapter is necessary because the internal parts of the conventional quick connect are installed from the back requiring a minimum opening which is larger than some thread sizes. It is therefore desirable to provide a low profile nipple which allows adequate clearance between the nipple and the roadway. It is further desirable to provide a nipple design that is suitable for large thread sizes as well as the smallest thread size. It is also desirable to provide a nipple design where the internal parts of the nipple are installed from the front of the nipple to allow the thread size to be as small as necessary without the need for a special adapter.

SUMMARY OF THE INVENTION

The device of the present invention addresses the aforementioned concerns. To accelerate the removal of spent oil conveniently, more completely, and easily from the crank case, a vacuum pump means is connected to the drain aperture to create vacuum within the spent oil container thereby drawing spent oil from the oil pan of the engine into the environmentally safe spent oil container external of the engine. A quick connect nipple is provided in the drain aperture that is adaptable for communication with the pump means including the vacuum means such that subsequent oil changes will merely require the hookup of the quick connect to a vacuum pump means engagable with a spent oil receptacle.

The device of the present invention includes a quick connect nipple releasably connected to the drain plug opening of the oil pan. The quick connect nipple is matingly and sealingly engagable with the drain plug opening and is matingly and sealingly engagable with a fitting or coupler located on a fuel egress conduit which is connected to the fluid storage receptacle through a suitable pump means. The quick connect nipple and coupler combination has a centrally located throughbore and means for effecting positive no spill closure of the nipple when the nipple is disengaged from the coupler.

Because of the internal configuration of a quick connect nipple, it is highly desirable that minute particles of iron and steel which become entrained in the lubricant be removed before such particles embed within the quick connect and prevent the ultimate seal of the quick connect. Therefore, a ring shaped or cylindrical shaped magnet having a center passage is secured at the inlet of the fitting member in the oil pan. As the spent oil is removed, the oil must pass through the center passage of the magnet, wherein the metallic particles are subject to the magnetic force and adhere to the magnet.

In addition, the quick connect nipple has a low profile configuration to provide adequate clearance from the ground when the nipple is disengaged from the coupler. The quick connect nipple is exposed less than an inch below the floor of the oil pan. Therefore, damage to the nipple is often avoided when the vehicle is traveling over rough or bumpy surfaces.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
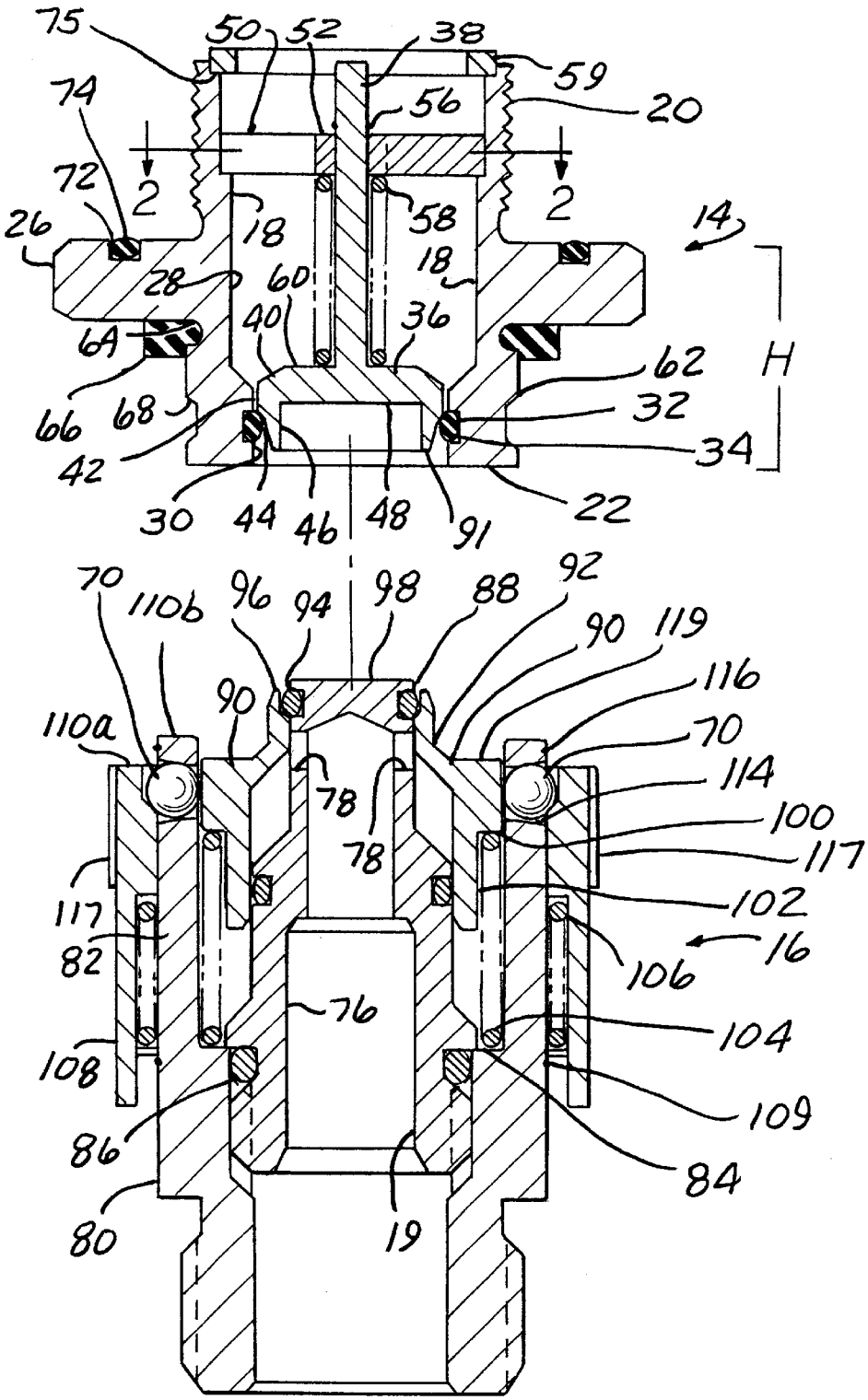
FIG. 1 is a cross sectional view of the invention including a quick connect nipple and coupler in the disengaged position.
Figure 3:
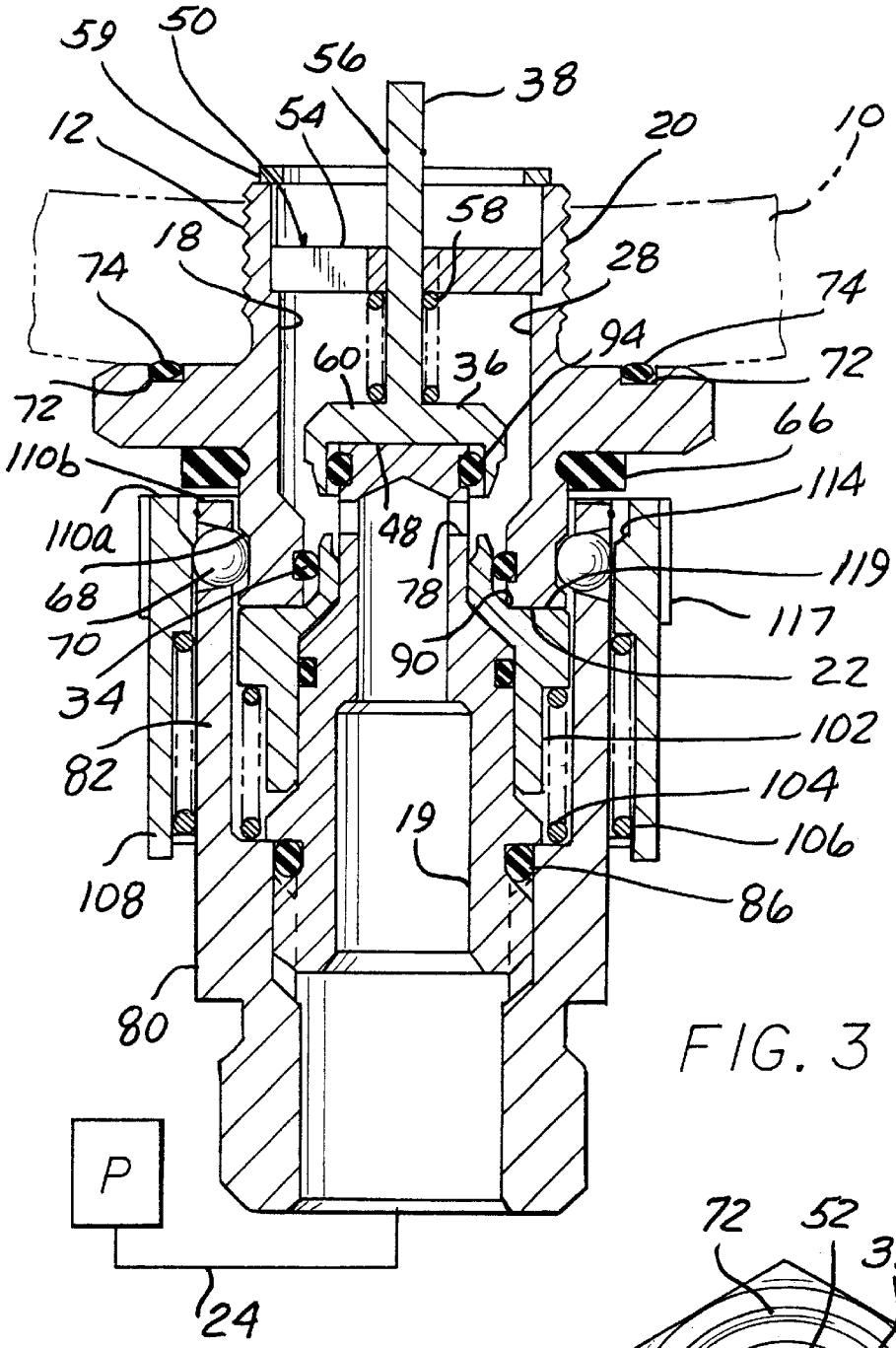
FIG. 3 is a side elevational view of the quick connect nipple located in an oil pan reservoir/sump and coupler in the engaged position.

The invention will be described within the environment of an oil pan reservoir of a vehicle, although the quick connect nipple of the present invention may be used in other fluid containment environments. An engine generally includes an oil pan reservoir 10 with a drain opening 12 at the bottommost region of the oil pan reservoir or sump 10. The present invention is a quick connect nipple 14 and coupler 16 that accesses the drain plug aperture 12 in order to draw the spent oil from the oil pan of the engine; and particularly a quick connect nipple 14 having a narrow profile which prevents possible destruction of any part of the quick connect apparatus extending from the drain opening 12. The present invention facilitates the oil change process performed on an internal combustion engine by including a low profile modification to include a fluid egress nipple fitting 14 releasably and sealingly positioned in the drain opening 12 of an associated oil pan or sump as shown in FIGS. 1 and 3. The fluid egress nipple 14 of the present invention generally has a hollow internal fluid conveying conduit or throughbore 18 defined therein and includes means for sealingly connecting the egress nipple 14 to the drain opening 12 of the associated oil pan 10 for permitting controlled fluid egress. In the embodiment shown in FIGS. 1 and 3, the fluid egress nipple includes a first threaded region 20 receivable within a mating region in the drain opening 12 of the associated oil pan 10 and a second end 22 opposed to the first end 20 which is sealingly connectible with a mating fitting located on an external fluid egress hose 24. The nipple 14 may also include an intermediately disposed outwardly facing geometric surface 26 defined thereon for facilitating insertion of the nipple 14 into the associated oil pan drain opening 12.

The fluid egress nipple 14 also includes means for effecting sealing closure of the fluid egress nipple 14 when uncoupled from the mating fitting located on the external fluid egress hose 24. The quick connect nipple 14 further includes means for effecting positive sealing closure of the fluid egress nipple by employing a positive sealing element therein. The positive sealing element will be discussed hereinafter.

The throughbore 18 is defined by the inner peripheral surface 28 of the quick connect nipple 14. The throughbore 18 may have an essentially cylindrical configuration and may include a reduced radius 30 at the second end as shown in FIG. 1. A radial groove 32 is formed circumferentially in the inner peripheral surface 28 for receiving a first O-ring 34. A movable member 36 is inserted in the throughbore 18. The movable member 36 includes an elongated stem portion 38 which flares out at an end to an essentially circular portion 40 with the general diameter of the reduced radius 30 of throughbore 18. The flared circular end 40 of the movable member 36 has a vertical section 42 with a notch 44 therein. The notch 44 is configured for tightly holding the first O-ring 34 therein. Therefore, when the movable member 36 is in the closed position, as shown in FIG. 1, the first O-ring 34 is tightly sealingly disposed between the groove 32 and notched portion 44 of the movable member 36. In the closed position, the movable member 36 blocks the fluid flow passageway of the throughbore 18. The flared circular portion 40 of the movable member 36 further includes an essentially boxed-shaped underside surface 46 having a flat horizontal surface 48 on the upper side adjacent to the stem portion 38.

Figure 2:
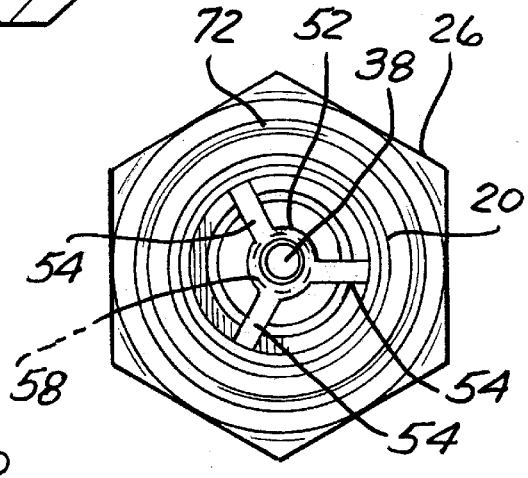
FIG. 2 is a cross sectional view of the quick connect nipple taken along lines 2—2 of FIG. 1.

A radial connector ring 50 is positioned in the throughbore 18, at the first threaded region 20. The radial connector ring 50 is seen more clearly in FIG. 2. The radial connector ring 50 includes a ring portion 52 enclosing the stem 38 of the movable member 36. The ring portion 52 is therefore centrally located in the throughbore 18 of the quick connect nipple 14. Radially extending from the ring portion 52 are three connection wings 54 that are securely attached to the peripheral wall 28 of the throughbore 18 at one end. The connection wings 54 are integrally connected to the ring portion 52 at the other end. Although three wings 54 are shown in FIG. 2, the number of wing connectors 54 may vary. The radial connection ring 50 maintains the stem 38 of the movable member 36 in a central location of the throughbore 18 but do not block the fluid passageway in the throughbore 18. The wing connectors 54 are connected to the inner peripheral surface 28 to maintain the radial connector ring 50 in place. Directly above the radial connector ring 50, a retainer clip 56 is securely enclosed around the stem 38 of the movable member 36. The ring portion 52 of radial connector ring 50 defines a stop for the retainer clip 56 on stem 38 to prevent the movable member 36 from moving in a direction toward the second end 22 beyond the point where the retainer clip 56 contacts the ring portion 52 of the radial connector ring 50. Therefore, the movable member 36 can reciprocally move within the throughbore 18 between portions where retainer clip 56 contacts the radial connector ring 50 and where the flared circular portion 40 contacts the radial connector ring 50. Other stop means or otherwise movement limiting means may be used to prevent the movable member 36 from moving too far in the direction toward second end 22. These stop or movement limiting means can include an O-ring around the stem 38 or a protuberance formed on the stem 38 of the movable member 36, a non-linear or bent portion on the stem 38 of the movable member 36, or a staked portion on the stem 38 in contact with a shelf (not shown) in the throughbore 18 of the nipple, the connector ring 50, or other stationary member in the throughbore 18.

A spring 58 is disposed in the throughbore 18 encircling the stem portion 38 of the movable member 36 between the ring portion 52 of the radial connector ring 50 and the horizontal upper surface 60 of the flared circular portion 40 of the movable member 36. The spring 58 is biased so that the movable member 36 is positioned as shown in FIG. 1 to close the fluid flow in the throughbore 18 and to provide the positive sealing element.

The outer surface 62 of the quick connect nipple 14 adjacent the second end 22 includes other features pertinent to the invention. A radial groove 64 is disposed in the outer surface 62 of the quick connect nipple 14 directly below the outwardly facing geometric surface 26. Groove 64 engages a ring holder 66 for a dust cap (not shown) onto the quick connect nipple 14. The ring holder 66 can be stretched over the quick connect nipple 14 and kept in place by friction. The ring holder 66 allows a dust cap to remain in place during routine vehicular operation and provide ready access to the quick connect nipple 14 during oil change operations. The dust cap is configured to permit sufficiently secure contact between the dust cap and the nipple 14 so that accidental disengagement of the dust cap during normal engine operation is prevented. Below the location of the ring holder 66 is a radial groove 68 in the quick connect nipple 14 for engaging a ball latch 70 from the external coupler 16 which will be discussed further. Another annular groove 72 is located along the upper horizontal surface of the outwardly facing geometric surface 26 for receiving a second O-ring 74. O-ring 74 prevents fluid leaks around the exterior of the quick connect nipple 14. A sealing washer may be used as an alternate seal.

The quick connect nipple 14 may further include a ring shaped or cylindrical magnet 59 having a center passage securely attached in a recess 75 formed in the upper surface of the first threaded region 20 of the nipple 14. Metallic particles that are produced by the movement of the internal combustion engine are flushed to the oil sump by the action of the oil through the oil distribution passages. To prevent these particles from flowing back into the lubrication system a cylindrical magnet 59 is positioned in the flow path of the oil during the oil changing process. It is preferred to securely attached the magnet 59 adjacent the first threaded region 20 of the nipple fitting 14 so that easy access to the metallic particles is available for cleaning when the fluid egress nipple 14 is removed from the drain opening 12. It is also preferable to have the maximum available surface area of the magnet 59 exposed to the oil in the oil sump 14 in order to expose the magnet 59 to a greater number of metallic particles. Therefore, the cylindrical magnet 59 is positioned at the entrance to the nipple 14 so that an upper surface of magnet 59 is exposed to the fluid in the sump and so that the oil flows through the center passage of the cylindrical magnet 59 before entering throughbore 18. Although a single cylindrical magnet 59 secured within the recess 75 is preferred, a plurality of small magnets may be secured in circular fashion to the upper surface of nipple 14 to achieve similar results.

A mating coupler 16 is also provided which can be connected to the conduit 24 feeding to a pump or a fluid reservoir and which couples to the quick connect nipple 14 to provide fluid transfer. The mating coupler 16 includes an inner tubular member 76 providing the passageway 19 for fluid flow therethrough. Apertures 78 are provided through the wall of the tubular member 76 such that when the coupler 16 is connected to the quick connect nipple, fluid can pass between the quick connect nipple 14 and coupler 16. An outer stationary tube 80 surrounds the inner tubular member 76 and having a portion 82 of the outer stationary tube 80 that is spaced away from the inner tubular member 76 for reasons discussed further. The outer stationary tube 80 has an inwardly facing shelf 84 disposed between the outer stationary tube 80 and the inner tubular member 76. An O-ring sealing member 86 is located just below shelf 84. At the connection end 88 of the coupler 16 and disposed between the outer tube 80 and inner tubular member 76 is a movable inner sleeve 90 having an upper portion 92 that blocks the passageway apertures 78 of the coupler 16. Another O-ring 94 disposed between a top portion 96 of the movable inner sleeve 90 and a top portion 98 of the inner tubular member 76 seals the passageway from fluid flow. The inner movable sleeve 90 has a downwardly facing horizontal wall 100 and vertical wall 102 meeting at a 90° angle corner. Disposed between this L-shaped corner and the shelf 84 of the outer stationary tube 80 is a spring 104 biasing the movable inner sleeve 90 in a position such that the passageway 78 of the inner tubular member 76 is sealed closed. An outer movable sleeve 108 encloses the outer tube 80, movable inner sleeve 90 and the inner tubular member 76 therein.

Another circular spring 106 is disposed between the outer movable sleeve 108 and the outer stationary tube 80. The second spring 106 is contained in place by another retainer clip 109 positioned on the outer surface of outer stationary tube 80. The second spring 106 of the coupler 16 is biased so that the outer movable sleeve 108 has its leading edge 110*a* adjacent to the leading edge 110*b* of the outer stationary tube 80. This position occurs when the coupler is connected to the quick connect nipple 14 as seen in FIG. 3. Rollers or balls 70 are positioned in radially dispersed opening 114 of the inner movable sleeve 90 when the coupler 16 is disengaged from the quick connect nipple 14. The balls 70 in opening 114 maintain the spring 106 in slight tension. Another retainer clip 116 is located on the outer surface of the outer stationary tube 80 at the connection end of the coupler 16. This retainer clip 116 prevents the outer sleeve 108 from inadvertently disengaging from the coupler 16.

To provide added protection to the female coupler 16, a protective bumper ring 117 may envelope at least a portion of the outer movable sleeve 108. The bumper ring 117 is preferably disposed around the coupler 16 adjacent to the leading edge 110*a* of the outer movable sleeve 108 to protect the coupler 16 if a user inadvertently drops the coupler 16 onto a hard surface.

Exposed edge 96 of movable inner sleeve 90 contacts exposed edge 91 of movable member 36 of nipple 14 and pushes movable member 36 into the throughbore 18 against spring 58 of the nipple 14 until leading flat surfce 119 of movable inner sleeve 90 comes to a stop against end 22 of the quick connect nipple 14. The O-ring 34 of the nipple maintains a seal against surface 92 of the movable inner sleeve. With the inner sleeve 90 of the coupler 16 secured against the nipple 14, the remaining coupler assembly moves around inner sleeve 90 against spring 104 until the connection end 90 of the inner tubular member 76 of the coupler contacts the lower horizontal surface of movable member 36 in the nipple 14.

Further movement of the coupler assembly against spring 104 of the coupler 16 and spring 58 of the nipple 14 forces movable member 36 further into the throughbore 18 of the nipple 14, thereby exposing the apertures 78 of the inner tubular member 76 and creating a fluid passage between the nipple 14 and coupler 16. At the same time the balls 70 of the coupler are forced into groove 68 of the nipple by spring 106 and the outer movable sleeve 108 moves over the balls 70 until it is stopped by retainer clip 116. This final move firmly engages the coupler 16 to the nipple 14 until manually released.

The coupler 16 is manually released from nipple 14 by the user sliding the outer movable sleeve 108 away from the nipple 14 so that balls or rollers 70 can again be received into opening 114. Movable inner sleeve 90 can then return to the location as seen in FIG. 1 so that the coupler 16 can be disengaged from the nipple 14.

The moveable member 36 of the quick connect nipple 14 returns to its position as shown in FIG. 1, such that the circular portion 40 of the movable member 36 is sealed against O-ring 34 to prevent spillage from the oil pan 10. In addition to providing a seal, the O-ring 34 also functions to restrict the movement of the member 36. As a backup safety, the movable member 36 is restricted in its movement by retainer clip 56 on the stem 38 of the movable member. The retainer clip 56 cannot move past the radial connector ring 50 located in the throughbore 18 of the quick connect nipple 14. When the quick connect nipple 14 is disengaged from the coupler 16, the exposed portion of nipple 14 from oil pan 10 is signified by H in FIG. 1. The low profile configuration of the quick connect nipple 14 of the current invention provides an exposed portion H having a length less than 1 inch and preferably approximately 0.750 inch. Therefore, the risk of damage to the nipple 14 is greatly reduced when the vehicle travels over rough surfaces.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A connecting device attachable to an access port of a fluid reservoir, the connecting device comprising:

a quick connect nipple having a first end mating the access port and a second end releasably engageable with an externally located fluid device, and having a throughbore therebetween defining a fluid passageway;

means for establishing a fluid tight and no-spill closure of said quick connect nipple when said nipple is disengaged from said fluid device; and wherein the means for establishing fluid tight closure of said quick connect nipple includes a movable member disposed in the throughbore of the quick connect nipple, said movable member having a means for limiting movement of the movable member toward the second end of said quick connect nipple, wherein said means for limiting movement of the movable member is located in the throughbore.

2. The connecting device of claim 1, wherein the means for limiting movement of the movable member includes a retainer clip connected to the movable member.

3. The connecting device of claim 2, further comprising a stationary member connected to the periphery of the throughbore and having a portion extending into the fluid passageway, said portion defining a stop for the retainer clip.

4. The connecting device of claim 3, wherein the portion defining the stop has a ring configuration and connecting portions radially connecting the ring configuration to the peripheral surface of the throughbore.

5. The connecting device of claim 4, wherein said ring configuration provides a through passage for fluid.

6. The connecting device of claim 2, wherein said movable member is biased to close the second end of the nipple.

7. The connecting device of claim 1, wherein the means for limiting movement of the movable member includes one of an O-ring and a staked portion on the movable member.

8. The connecting device of claim 1, wherein the means for limiting movement of the movable member includes a protuberance on the movable member and a stationary member having a portion defining a stop for the protuberance.

9. The connecting device of claim 1, wherein the means for limiting movement of the movable member includes a non-linear portion on the movable member proximate to the first end and a stationary member connected in the periphery of the throughbore and having a portion extending into the fluid passageway, said portion of the stationary member defining a stop for the non-linear portion of the movable member.

10. The connecting device of claim 1, further comprising a mating quick connect coupler positioned on the externally located fluid device and means for establishing fluid flow between the fluid reservoir and fluid device when said coupler is engaged to said fluid device.

11. The connecting device of claim 1 further comprising a magnet secured to the first end of the quick connect nipple for capturing metallic material in the fluid reservoir.

12. The connecting device of claim 1, wherein a portion of the quick connect nipple is exposed from the access port, and wherein the exposed portion has a length less than one inch.

13. The connecting device of claim 12, wherein the exposed portion has a length approximately 0.750 inch.

14. A quick connector for an access port comprising:

a quick connect nipple; said quick connect nipple having a first end threadably mating the access port and a second end, a throughbore therebetween defining a fluid passageway, and a movable member located in the passageway, wherein said movable member is centrally located in the passageway by a stationary member.

15. The quick connector of claim 14, wherein said movable member has a stem portion and a flared end integral with the stem portion, said stem portion having a movement limiting means proximate to an end port and distal from the flared end.

16. The quick connector of claim 15, wherein said stationary member defines a stop for the movement limiting means on the stem portion of the movable member.

17. The quick connector of claim 15, wherein the movable member is biased so that the flared end sealingly closes the fluid passageway.

18. The quick connector of claim 15, wherein the movable member is biased so that the movement limiting means contacts the stationary member.

19. The quick connector of claim 14 further comprising a quick connect coupler having connecting means for releasably engaging the quick connect nipple.

20. The quick connector of claim 19, wherein said quick connect coupler includes a center tubular member having a side passageway therethrough and means for closing said side passageway when said quick connect coupler disengaged from the quick connect nipple.

21. The quick connector of claim 19, further including means for protecting the connecting means of said coupler.

22. The quick connector of claim 21, wherein said coupler has a movable outer surface and the means for protecting the connecting mean of said coupler includes a protective bumper enveloping at least a portion of the outer surface of the coupler.

23. The quick connector of claim 14, further comprising a magnet secured to the first end of the quick connect nipple.

* * * * *